US006875969B2

(12) United States Patent
Lee

(10) Patent No.: US 6,875,969 B2
(45) Date of Patent: Apr. 5, 2005

(54) MICROWAVE OVEN AND METHOD OF CONTROLLING THE SAME

(75) Inventor: Won-Woo Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 64 days.

(21) Appl. No.: 10/372,408

(22) Filed: Feb. 25, 2003

(65) Prior Publication Data

US 2004/0104222 A1 Jun. 3, 2004

(30) Foreign Application Priority Data

Nov. 29, 2002 (KR) ..... 10-2002-0075158

(51) Int. Cl.[7] ..... H05B 6/50
(52) U.S. Cl. ..... 219/707; 219/716
(58) Field of Search ..... 219/707, 705, 219/703, 704, 702, 715, 716; 99/325, DIG. 14

(56) References Cited

U.S. PATENT DOCUMENTS

RE31,094 E * 11/1982 Kobayashi et al. ..... 219/707
4,484,065 A * 11/1984 Ueda ..... 219/707
4,864,088 A 9/1989 Hiejima et al.
5,155,339 A * 10/1992 An ..... 219/707
5,445,009 A 8/1995 Yang et al.
5,796,081 A * 8/1998 Carlsson et al. ..... 219/711
6,222,456 B1 * 4/2001 Tice ..... 340/630
2001/0030187 A1 * 10/2001 Shon et al. ..... 219/704

FOREIGN PATENT DOCUMENTS

JP 02146972 A * 6/1990

* cited by examiner

*Primary Examiner*—Teresa J. Walberg
(74) *Attorney, Agent, or Firm*—Staas & Halsey LLP

(57) ABSTRACT

A microwave oven includes a control unit which sets sampling intervals to accumulate humidity values measured by a humidity sensor, and controls a cooking end time of food according to an accumulated humidity value obtained by accumulating the humidity values measured during the set sampling intervals. Accordingly, the microwave oven prevents overcooking of the food, for example, that does not require a further cooking after initial generation of steam thereof. The microwave oven may set sampling intervals through several measurements to improve the reliability thereof. Moreover, the microwave oven may learn an operation of setting sampling intervals according to cooking conditions so as to finish a cooking according to the set sampling intervals where a later set cooking condition corresponds to the learned cooking condition.

32 Claims, 8 Drawing Sheets

MICROWAVE OVEN AND METHOD OF CONTROLLING THE SAME

CROSS-REFERENCE TO RELATED APPLICATIONS

This application claims the benefit of Korean Patent Application No. 2002-75158, filed Nov. 29, 2002, in the Korean Intellectual Property Office, the disclosures of which are incorporated herein by reference.

BACKGROUND OF THE INVENTION

1. Field of the Invention

The present invention relates to a microwave oven, and a method of controlling the same, which performs a cooking operation using a humidity sensor.

2. Description of the Related Art

Generally, microwave ovens perform cooking operations with the aid of atmospheric sensors, such as a humidity sensor, a temperature sensor and a gas sensor, and a weight sensor to measure a weight of food.

Where a cooking is performed according to cooking conditions, a humidity sensor employed in a microwave oven measures water vapor in a cooking chamber. The humidity value measured by the humidity sensor varies as time elapses after the cooking is initiated. That is, as shown in FIG. 1, where food is heated by microwaves of the microwave oven, the amount of water vapor generated during an initial period is small, as compared to the later period of time where the cooking continues.

The humidity value of the humidity sensor varies according to cooking states. Accordingly, it is possible to recognize a completion degree of the cooking by measuring the variation of the humidity value. Furthermore, it is possible to automatically finish the cooking based on the result measured by the humidity sensor.

For ease of understanding, technologies relating to the above operations are described with reference to FIG. 2.

A humidity sensor measures water vapor in a cooking chamber as a cooking operation is performed. Whenever a cooking time has reached respective preset measurement periods of the humidity sensor, while humidity values measured by the humidity sensor are scanned, the humidity values of the humidity sensor obtained by the scanning are accumulated. Generally, an accumulated humidity value corresponding to the scanned humidity values increases as a cooking time elapses. Referring to FIG. 2, a first cooking time T1 to have the accumulated humidity value reach a predetermined value is calculated, and a second cooking time T2 required to perform a further cooking is calculated based on the first cooking time T1. The second cooking time T2 may be different depending on the respective weights and cooking menus (warming, thawing, etc.) set for foods. Accordingly, it is difficult to uniformly set the second cooking time T2. Therefore, in a conventional method/microwave oven, pieces of information of respective cooking times are drawn as a table and pre-stored in the microwave oven, and a second cooking time corresponding to a first cooking time, which is calculated during a cooking, is searched for in the table and obtained.

A further cooking is a process executed until the cooking is finished after the first cooking time T1 is found using the humidity sensor. After the second cooking time T2 has elapsed, a heating device such as a magnetron in operation is turned off, and thus the cooking is automatically finished.

However, in the conventional microwave oven, a measurement period of the humidity sensor may be too long relative to the second cooking time T2 for certain types of food. That is, for some food, the second cooking time T2 should be short and may only require a brief further cooking. In such a case, the food may be overcooked as the microwave oven continues to heat the food while determining the first cooking time T1. For example, where a cooking condition such as a "cooking popcorn" or "warming vegetables" is set, a lot of heat is not required to finish a cooking operation thereof after the food starts to produce steam. Therefore, the cooking operation must be finished within a few seconds after the first cooking time T1. However, because the measurement period of the humidity sensor is long, the cooking operation may not be finished at an appropriate time. Thus, the food is excessively overcooked.

SUMMARY OF THE INVENTION

Accordingly, it is an aspect of the present invention to provide a microwave oven, and a method of controlling the same, which prevents overcooking of food by adjusting a measurement period of a humidity sensor.

Additional aspects and advantages of the invention will be set forth in part in the description which follows and, in part, will be obvious from the description, or may be learned by practice of the invention.

To achieve the above and/or other aspects of the present invention, there is provided a microwave oven comprising a heating unit to cook food, a cooking chamber which receives the food, a sensor which measures a condition of air in the cooking chamber, and a control unit which sets sampling intervals to accumulate values measured by the sensor, and controls a cooking end time of the food according to an accumulated value obtained by accumulating the measured values during the set sampling intervals.

The control unit may finish a cooking operation of the food in response to the accumulated value reaching a preset value.

The sensor may be a humidity sensor which is disposed on a discharge path extending from the cooking chamber and measures a content of moisture generated from the food.

To achieve the above and/or other aspects of the present invention, there is provided another microwave oven comprising a heating unit to cook food, an input unit which receives a cooking condition of the food, a humidity sensor which measures a content of moisture generated from the food, and a control unit which sets sampling intervals to accumulate humidity values measured by the humidity sensor, and controls a cooking end time of the food according to an accumulated humidity value obtained by accumulating the humidity values during learned sampling intervals of the oven in response to the cooking condition set through the input unit corresponding to one of previously learned cooking conditions of the oven.

The previously learned cooking conditions may be prior cooking conditions processed by the oven before the setting of the cooking condition, and the control unit may perform a learning operation of drawing up a table in which the learned sampling intervals are set to correspond to the respective prior cooking conditions set through the input unit. The microwave oven may further comprise a storage medium which stores the table.

Each of the learned sampling intervals and the sampling intervals for the current cooking condition may be set to 2 to 4 seconds.

The learned cooking conditions may include a cooking popcorn condition and a warming vegetables condition.

To achieve the above and/or other aspects of the present invention, there is provided a method of controlling a microwave oven having a humidity sensor and a cooking chamber which receives food, the method comprising setting a cooking condition of the food, measuring a condition of air in the cooking chamber using the humidity sensor while a cooking operation of the food is performed according to the set cooking condition, setting sampling intervals to accumulate humidity values measured by the humidity sensor, and comparing an accumulated humidity value obtained by accumulating the humidity values during the set sampling intervals with a preset value and finishing the cooking operation with respect to the set cooking condition according to the compared result.

The finishing of the cooking operation may be performed according to an accumulated humidity value obtained by accumulating the humidity values during learned sampling intervals of the oven in response to the set cooking condition corresponding to one of previously learned cooking conditions of the oven.

The previously learned cooking conditions may be prior cooking conditions which are processed by the oven before the setting of the cooking condition. The processing of the prior cooking conditions may include drawing up a table in which the learned sampling intervals are set to correspond to the respective prior cooking conditions and storing the table in a storage medium of the oven.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
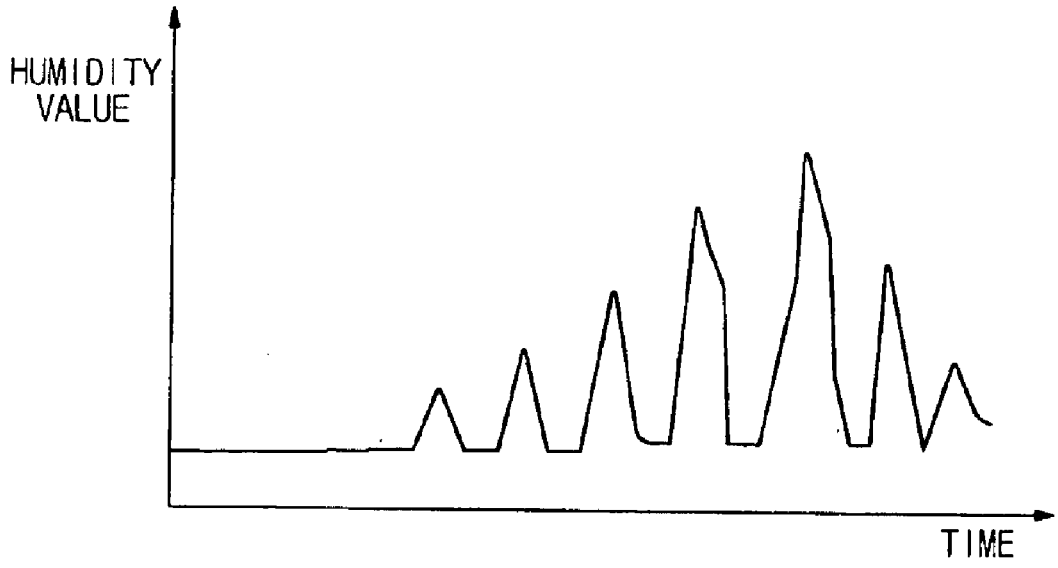
FIG. 1 (PRIOR ART)
FIG. 1 is a graph illustrating a humidity value of a humidity sensor varied according to cooking states.
Figure 2:
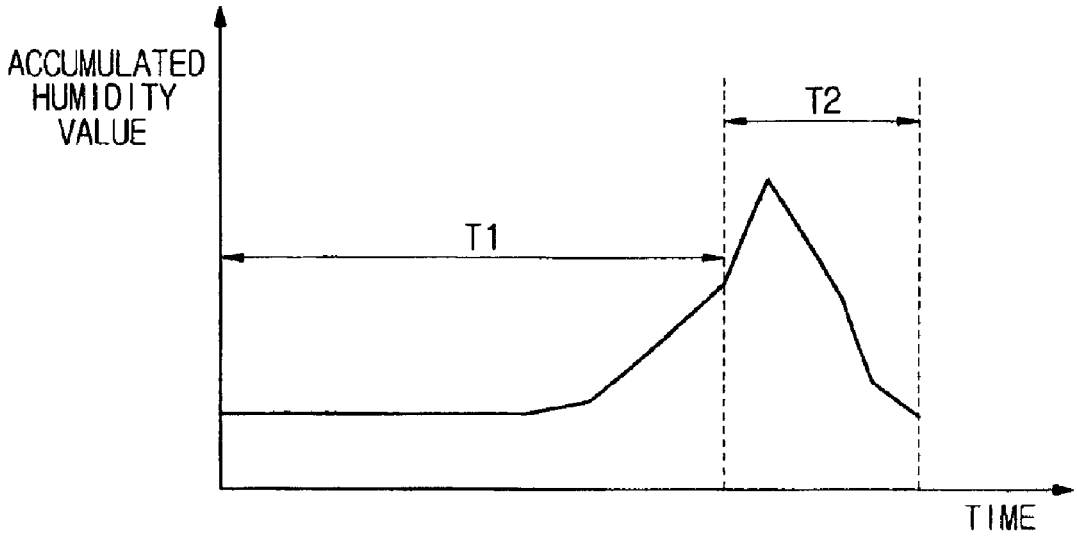
FIG. 2 (PRIOR ART)
FIG. 2 is a graph illustrating an accumulated humidity value obtained by accumulating humidity values measured by a humidity sensor every measurement period of the humidity sensor.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
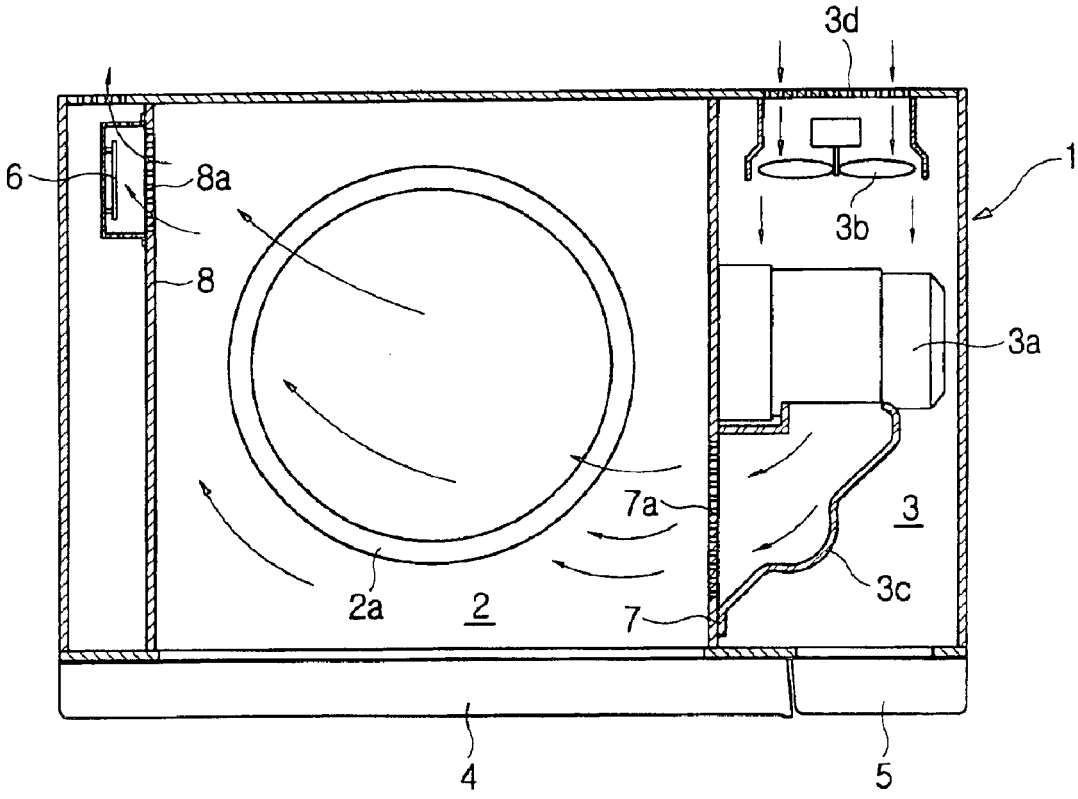
FIG. 3 is a sectional view illustrating the construction of a microwave oven according to an embodiment of the present invention.

FIG. 3 shows the construction of a microwave oven according to an embodiment of the present invention.

As shown in FIG. 3, the microwave oven includes an oven body 1, a door 4, a control panel 5, and a humidity sensor 6. In the oven body 1, a cooking chamber 2 and a machine room 3 are formed. The door 4 is hingedly connected to the oven body 1 to open and close the cooking chamber 2. The control panel 5 is mounted on a front of the oven body 1 and provided with an input unit and a display unit, which will be described below. In this case, the input unit is designed so as to have a plurality of function buttons mounted thereon, and the display unit is adapted to display information. The humidity sensor 6 senses a condition of air in the cooking chamber 2.

A cooking tray 2*a* is mounted on a bottom of the cooking chamber 2 in a form of a turntable. An air inlet 7*a* is formed in a front portion of a sidewall 7 of the cooking chamber 2. External air flows into the cooking chamber 2 through the air inlet 7*a*. An air outlet 8*a* is formed in a back portion of another sidewall 8 of the cooking chamber 2 to allow air in the cooking chamber 2 to be discharged to the outside of the microwave oven.

The machine room 3 includes a magnetron 3*a* which generates microwaves, a cooling fan 3*b* which sucks external air into the machine room 3 to cool electronic devices of the machine room 3, and an air guide duct 3*c* which guides air flowing into the machine room 3 to the air inlet 7*a*. The cooling fan 3*b* is disposed between a back wall of the machine room 3 and the magnetron 3*a*. A plurality of air suction holes 3*d* are formed in the back wall of the machine room 3, and enable external air to flow into the microwave oven.

The humidity sensor 6 is disposed at a position outside the sidewall 8 of the cooking chamber 2 at a position opposite to the air outlet 8*a*, wherein the position is in a path through which air is discharged. Therefore, the humidity sensor 6 may detect a humidity of air being discharged through the air outlet 8*a* from the cooking chamber 2. The humidity sensor 6 is electrically connected to a circuit board (not shown) arranged in the control panel 5.

Figure 4:
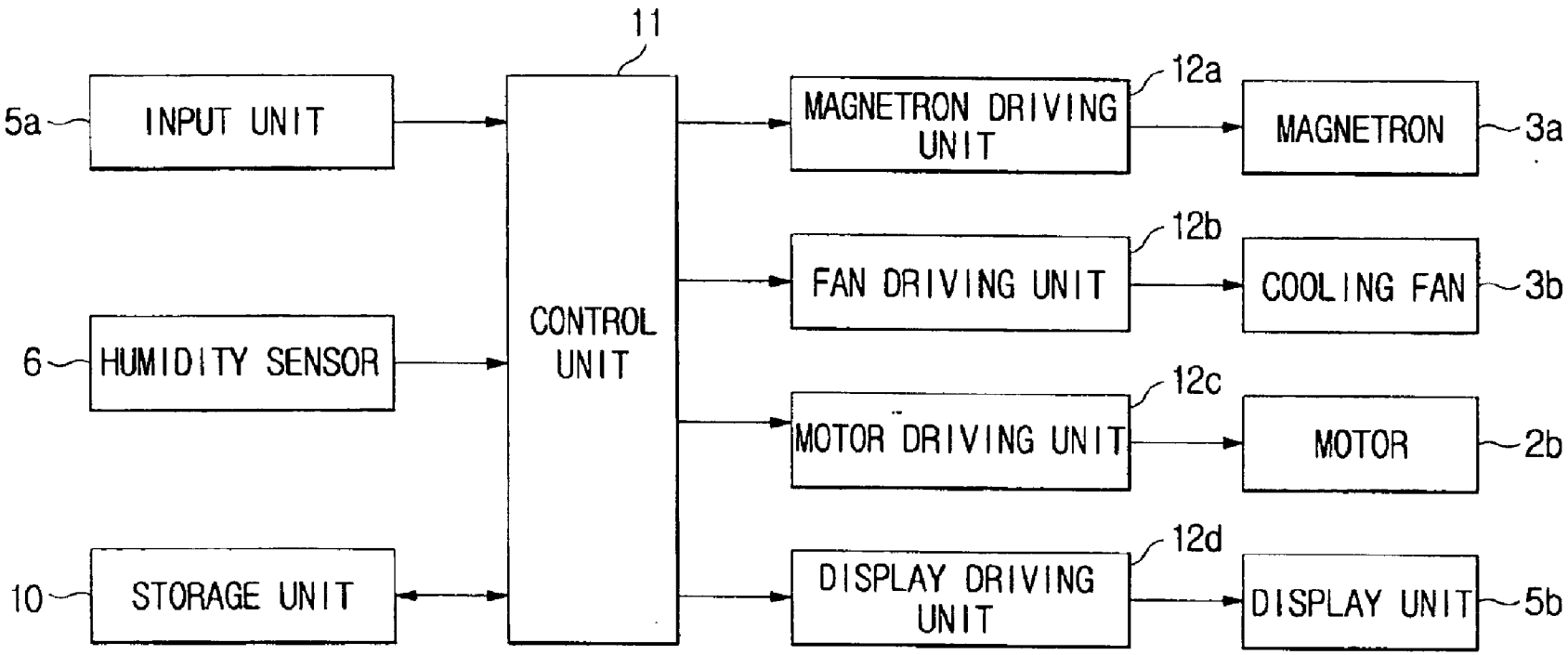
FIG. 4 is a control block diagram of the microwave oven shown in FIG. 3.

FIG. 4 shows a control block diagram of the microwave oven shown in FIG. 3.

As shown in FIG. 4, the microwave oven includes a control unit 11 which controls an entire operation of the microwave oven. An input unit 5*a* mounted on the control panel 5 is electrically connected to the control unit 11 and receives input operating instructions used to set cooking conditions. The humidity sensor 6 and a storage unit 10 are electrically connected to the control unit 11. The humidity sensor 6 detects humidity formed during a cooking operation.

Furthermore, the control unit 11 is electrically connected to a magnetron driving unit 12*a* which drives the magnetron 3*a*, a fan driving unit 12*b* which drives the cooling fan 3*b*, a motor driving unit 12*c* which drives a motor 2*b* that rotates the cooking tray 2*a*, and a display driving unit 12*d* which drives the display unit 5*b*.

Where a predetermined cooking condition is set through the manipulation of the input unit 5*a* after food is placed on the cooking tray 2*a*, the control unit 11 controls the magnetron driving unit 12*a* to drive the magnetron 3*a*. The magnetron 3*a* generates microwaves to cook the food.

During a cooking operation of the microwave oven, external air is supplied to the inside of the cooking chamber 2 through the air inlet 7*a* by the cooling fan 3*b*, as indicated by arrows in FIG. 3. The supplied air is discharged to the outside of the microwave oven through the air outlet 8*a*, from the cooking chamber 2, together with moisture generated from the food being cooked. The humidity sensor 6 detects the humidity of the discharged air and transmits a detection signal to the control unit 11.

Figure 5:
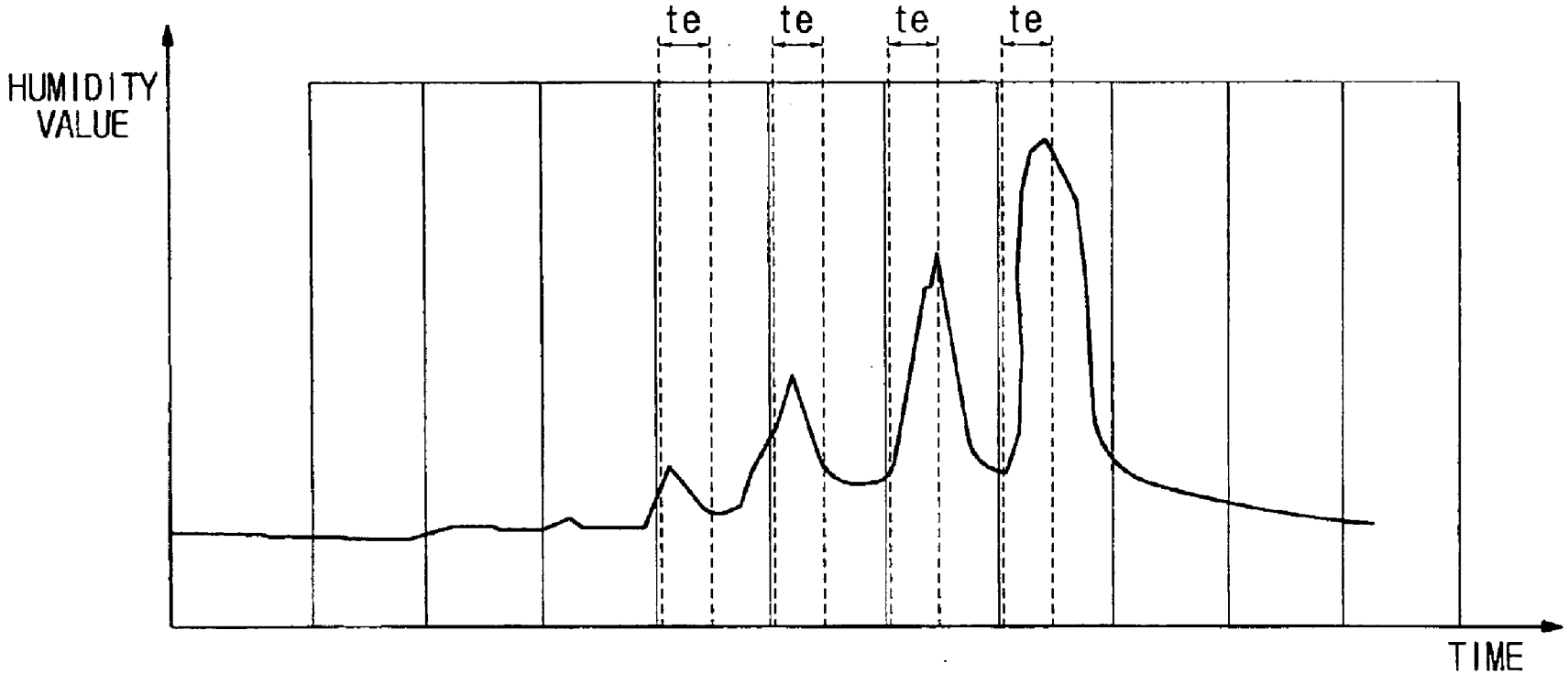
FIG. 5 is a graph illustrating the operation of setting sampling and non-sampling intervals of a humidity sensor of the microwave oven, according to the present invention.

FIG. 5 shows a graph illustrating an operation of setting sampling and non-sampling intervals for the humidity sensor 6, according to the present invention.

Each of regular periods sectioned by solid lines of FIG. 5 (corresponding to measurement periods of the humidity sensor 6) includes a sampling interval and a non-sampling interval. That is, the control unit 11 sets an interval in which humidity values measured by the humidity sensor 6 are relatively high as a sampling interval "te." In this case, the sampling interval "te" corresponds to an interval where the humidity sensor 6 senses humidity values which vary greatly. The remaining interval of the each regular period, which is not the sampling interval "te," is set as an non-sampling interval in which the humidity sensor 6 senses humidity values which do not vary greatly. A sampling is repeatedly performed in regularly repeated sampling intervals. Variations in sampled values are explained by the fact that a high humidity value is obtained where a distance between the food disposed on the rotating tray 2*a* and the humidity sensor 6 is short, while a low humidity value is obtained where the distance therebetween is long, as a result of a rotation of the tray 2*a*.

The control unit 11 accumulates humidity values measured by the humidity sensor 6 during sampling intervals "te," and controls a cooking operation according to an accumulated humidity value corresponding to the measured humidity values. Therefore, the control unit 11 prevents overcooking of the food.

Figure 6:
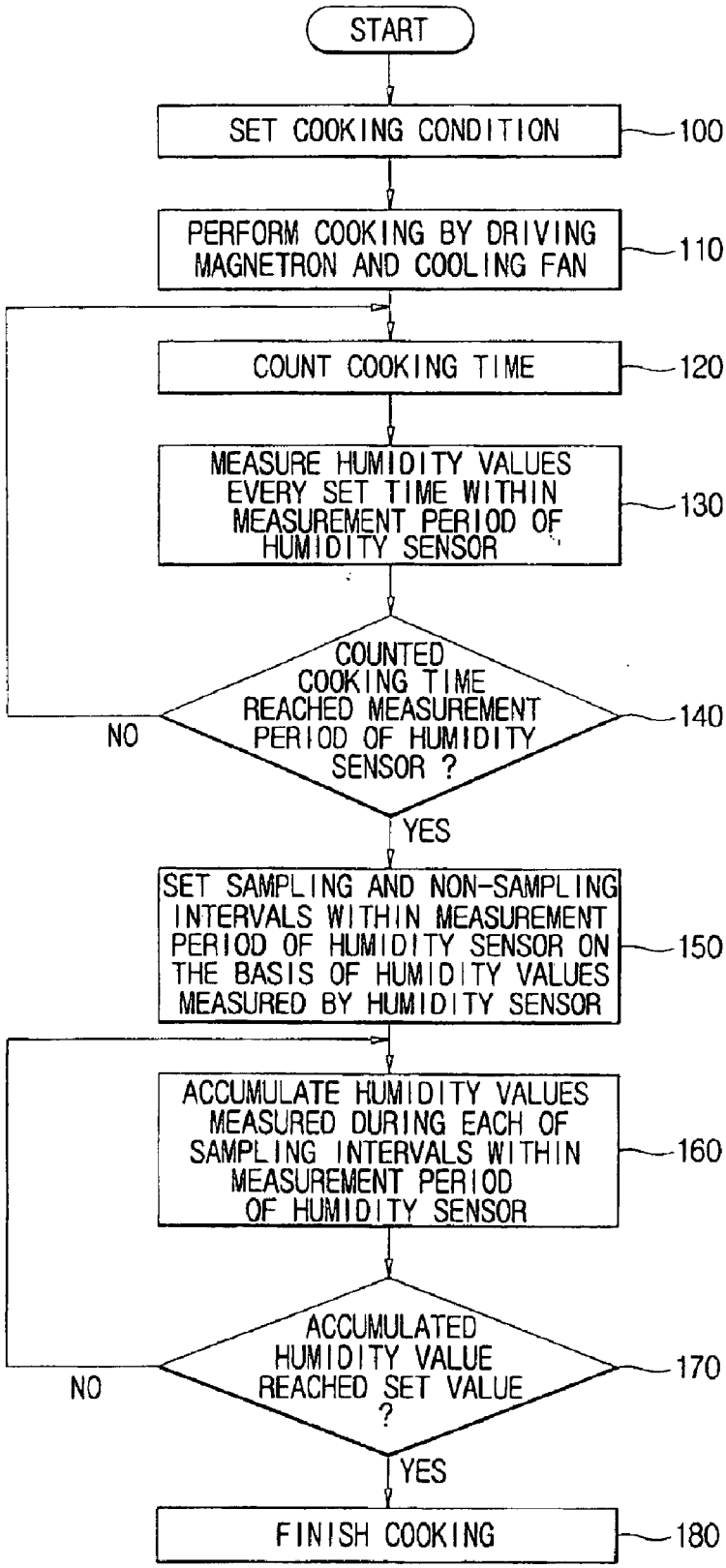
FIG. 6 is a flowchart illustrating a method of controlling a microwave oven, according to the present invention.

FIG. 6 is a flowchart illustrating a method of controlling the microwave oven according to the present invention.

In operation 100, the control unit 11 sets a desired cooking condition in response to an operating instruction input through the input unit 5*a*. In operation 110, the control unit 11 performs a cooking operation by controlling the magnetron driving unit 12*a* and the fan driving unit 12*b* to drive the magnetron 3*a* and the cooling fan 3*b*, respectively.

In operation 120, the control unit 11 counts a cooking time, and in operation 130, performs a measuring operation by scanning humidity values measured by the humidity sensor 6 every set time (for example, 0.5 seconds) within a measurement period (for example, 10 seconds) of the humidity sensor 6. While the measuring operation is performed, the control unit 11 determines whether a counted cooking time has reached the measurement period of the humidity sensor 6, in operation 140. Where the counted cooking time has not reached the measurement period of the humidity sensor 6, the control unit 11 returns to the operation 120 and continues to count the cooking time. Where the counted cooking time has reached the measurement period, the control unit 11 sets sampling and non-sampling intervals according to the humidity values measured by the humidity sensor 6, in operation 150.

In operation 160, the control unit 11 accumulates the humidity values measured by the humidity sensor 6 during each of the set sampling intervals as each sampling interval elapses. In operation 170, the control unit 11 determines whether an accumulated humidity value has reached a set cooking end value preset according to the cooking condition, in which a further cooking is not actually required. For example, the cooking condition in which a further cooking is not actually required corresponds to a specific cooking condition such as a "cooking popcorn" condition or a "warming vegetables" condition.

Where it is determined that the accumulated humidity value has not reached the set cooking end value in the operation 170, the control unit 11 returns to the operation 160 and continues to accumulate the humidity values measured by the humidity sensor 6. Where it is determined that the accumulated humidity value has reached the set cooking end value in the operation 170, the control unit 11 finishes the cooking by stopping the driving of the magnetron 3*a* and the cooling fan 3*b*. That is, the cooking is finished and a further cooking is not performed in operation 180.

Figure 7:
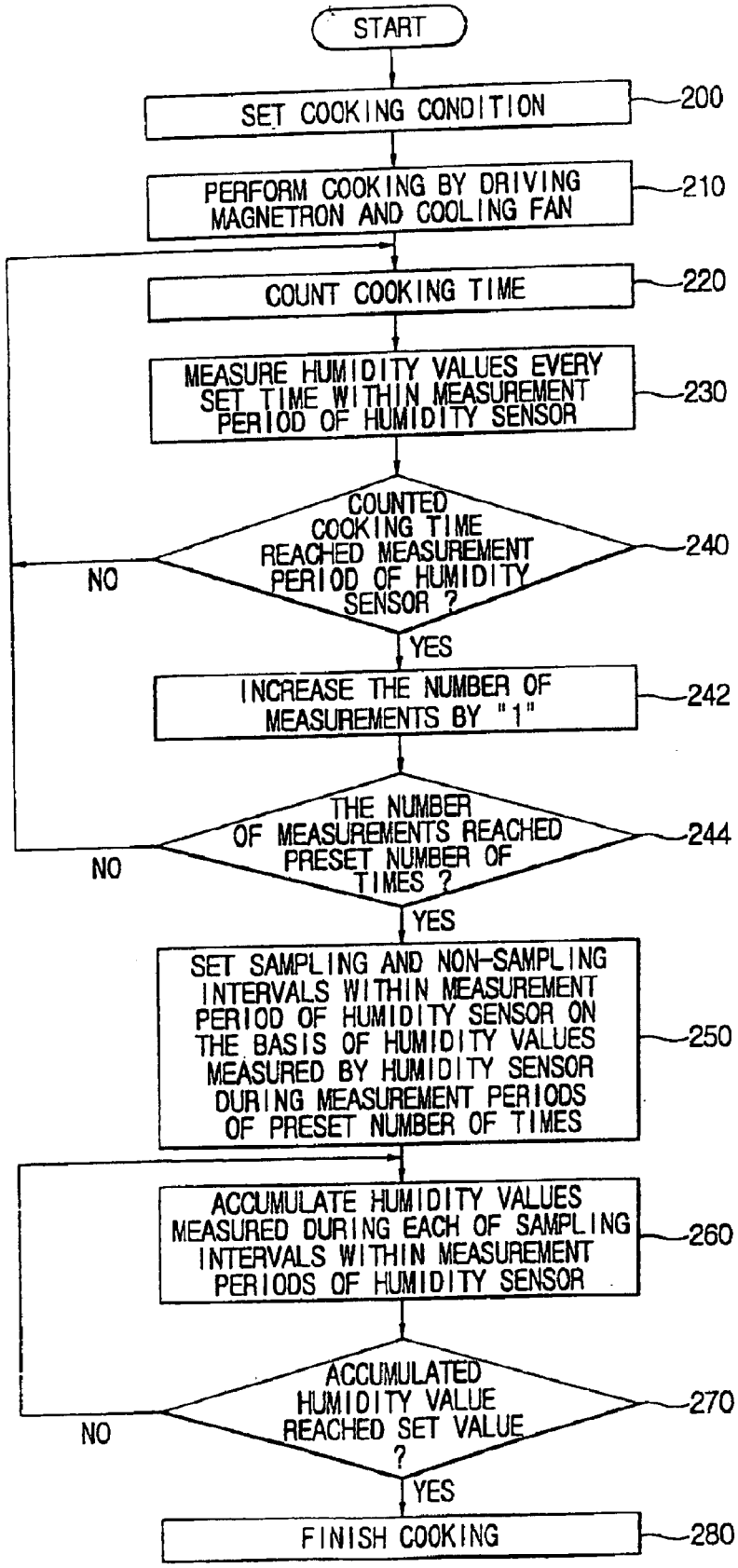
FIG. 7 is a flowchart illustrating another method of controlling a microwave oven, according to the present invention.

FIG. 7 is a flowchart illustrating another method of controlling the microwave oven according to the present invention. In this method, a process of setting sampling intervals is performed after performing the measurement of humidity values of the humidity sensor 6 for a preset number of times.

In operation 200, the control unit 11 sets a desired cooking condition in response to an operating instruction input through the input unit 5*a*. In operation 120, the control unit 11 performs a cooking operation by controlling the magnetron driving unit 12*a* and the fan driving unit 12*b* to drive the magnetron 3*a* and the cooling fan 3*b*, respectively.

In operation 220, the control unit 11 counts a cooking time, and in operation 230, performs a measuring operation by scanning humidity values measured by the humidity sensor 6 every set time (for example, 0.5 seconds) within a measurement period (for example, 10 seconds) of the humidity sensor 6. While the measuring operation is performed, the control unit 11 determines whether a counted cooking time has reached the measurement period of the humidity sensor 6, in operation 240. Where the counted cooking time has not reached the measurement period of the humidity sensor 6, the control unit 11 returns to the operation 220 and continues to count the cooking time. Where the counted cooking time has reached the measurement period, the control unit 11 updates and increases the number of measurements by "1" in operation 242. In operation 244, the control unit 11 determines whether the number of measurements has reached a preset number of times. Where it is determined that the number of measurements has not reached the preset number of times, the control unit 11 returns to the operation 220, resets the counted cooking time value and counts a cooking time. Where it is determined that the number of measurements has reached the preset number of times, the control unit 11 sets sampling and non-sampling intervals according to the humidity values measured by the humidity sensor 6 during the measurement periods of the preset number of times, in operation 250.

In operation 260, the control unit 11 accumulates the humidity values measured by the humidity sensor 6 during each of the set sampling intervals as each sampling interval elapses. In operation 270, the control unit 11 determines whether an accumulated humidity value has reached a set cooking end value preset according to the cooking condition in which further cooking is not actually required. For example, the cooking condition in which a further cooking is not actually required corresponds to a specific cooking condition such as a "cooking popcorn" condition or a "warming vegetables" condition.

Where it is determined that the accumulated humidity value has not reached the set cooking end value in the operation 270, the control unit 11 returns to the operation 260 and continues to accumulate the humidity values measured by the humidity sensor 6. Where it is determined that the accumulated humidity value has reached the set cooking end value in the operation 270, the control unit 11 finishes the cooking by stopping the driving of the magnetron 3*a* and the cooling fan 3*b*. That is, the cooking is finished and a further cooking is not performed in operation 280.

Figure 8:
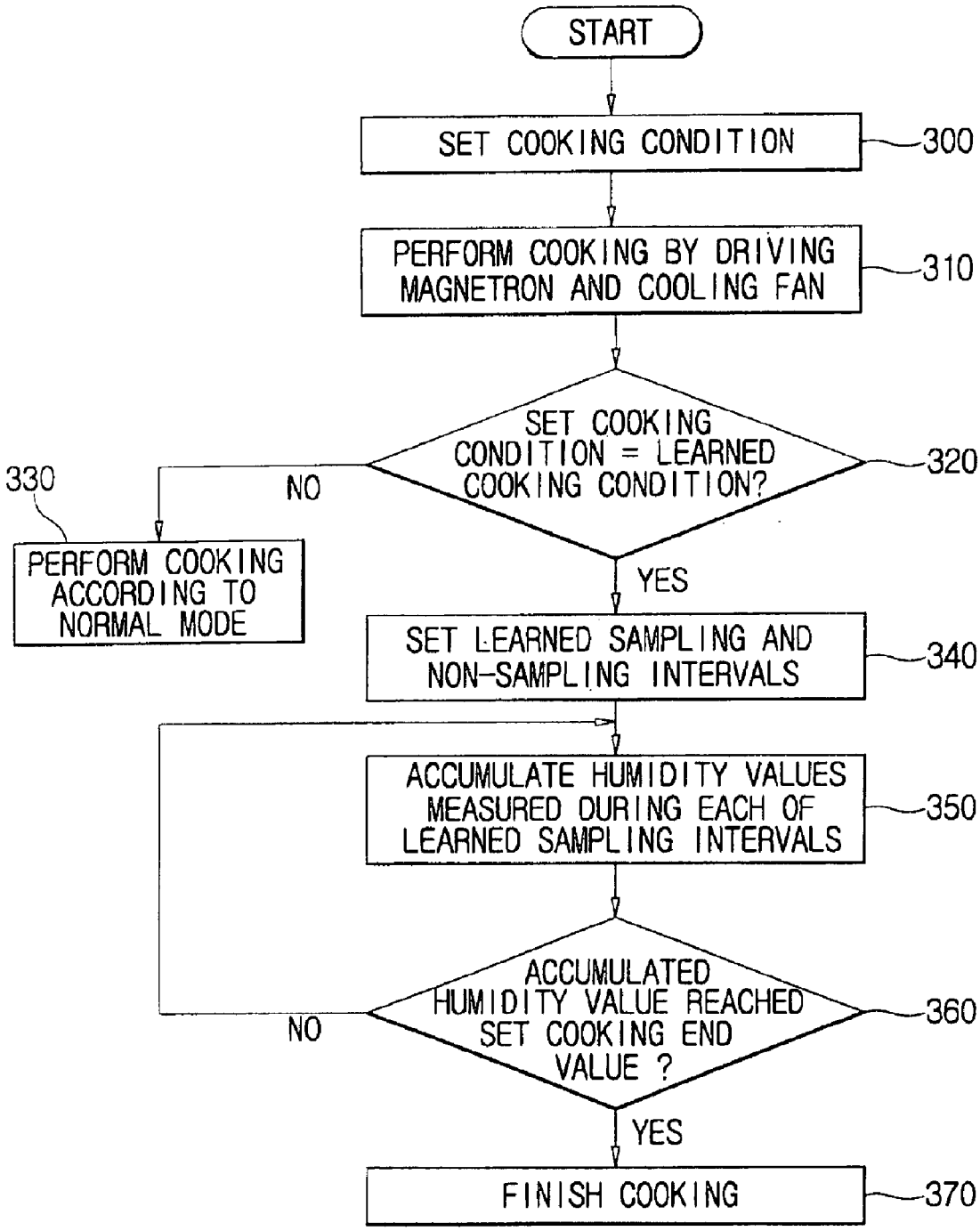
FIG. 8 is a flowchart illustrating yet another method of controlling a microwave oven, according to the present invention.

FIG. 8 is a flowchart illustrating yet another method of controlling the microwave oven according to the present invention. In this method a process of previously learning an operation of setting sampling intervals according to cooking conditions, by the microwave oven, and finishing a cooking according to the learned information at the time of the cooking is utilized. In this case, a learning operation represents an operation of drawing up a table in which sampling intervals are set to correspond to respective cooking conditions according to any of the above-described methods of FIGS. 6 and 7.

In operation 300, the control unit 11 sets a desired cooking condition in response to an operating instruction input through the input unit 5*a*. In operation 310, the control unit 11 performs a cooking operation by controlling the magnetron driving unit 12*a* and the fan driving unit 12*b* to drive the magnetron 3*a* and the cooling fan 3*b*, respectively.

In operation 320, the control unit 11 determines whether the set cooking condition corresponds to a cooking condition previously learned by the microwave oven. Where it is determined that the set cooking condition does not correspond to the learned cooking condition, the control unit 11 performs a cooking operation according to a normal mode in operation 330. In this case, the control unit 11 performs an operation of setting sampling intervals according to any of the methods of FIGS. 6 and 7, and finishes the cooking operation according to the sampling intervals.

Where it is determined that the set cooking condition corresponds to the learned cooking condition in the operation 320, the control unit 11 sets learned sampling and non-sampling intervals by searching a table, which is previously drawn up, in operation 340.

In operation 350, the control unit 11 accumulates humidity values measured by the humidity sensor 6 during each of the learned sampling intervals as each learned sampling interval elapses. In operation 360, the control unit 11 determines whether an accumulated humidity value has reached a set cooking end value preset according to the cooking condition, in which a further cooking is not actually required. For example, the cooking condition in which a further cooking is not actually required corresponds to a specific cooking condition such as a "cooking popcorn" condition or a "warming vegetables" condition.

Where it is determined that the accumulated humidity value has not reached the set cooking end value in the operation 360, the control unit 11 returns to the operation 350 and continues to accumulate the humidity values measured by the humidity sensor 6. Where it is determined that the accumulated humidity value has reached the set cooking end value in the operation 360, the control unit 11 finishes the cooking by stopping the driving of the magnetron 3*a* and the cooling fan 3*b* in operation 370.

As described above, the present invention provides a microwave oven, and a method of controlling the same, which sets sampling intervals in which a humidity sensor senses humidity values that vary greatly, within respective measurement periods of the humidity sensor, and finishes a cooking based on an accumulated humidity value obtained by accumulating the humidity values measured by the humidity sensor during the set sampling intervals. Accordingly, the present microwave oven prevents overcooking of food where a further cooking is not actually required for the food after an initial generation of steam from that food.

In addition, the present microwave oven can be set sampling intervals through repeated measurements, thereby improving the reliability thereof. Moreover, the present microwave oven can learn an operation of setting sampling intervals according to cooking conditions, and finish a cooking according to the set sampling intervals where a later set cooking condition corresponds to the learned cooking condition, thus promptly and conveniently performing cooking operations.

Although a few embodiments of the present invention have been shown and described, it would be appreciated by those skilled in the art that changes may be made in these embodiments without departing from the principles and spirit of the invention, the scope of which is defined in the appended claims and their equivalents.

What is claimed is:

1. A microwave oven, comprising:

a heating unit to cook food;

a cooking chamber which receives the food;

a sensor which measures a condition of air in the cooking chamber; and a control unit which sets sampling intervals to accumulate values measured by the sensor, and controls a cooking end time of the food according to an accumulated value obtained by accumulating the values measured during the set sampling intervals.

2. The microwave oven according to claim 1, wherein the control unit finishes a cooking operation of the food in response to the accumulated value reaching a preset value.

3. The microwave oven according to claim 1, wherein the sensor is a humidity sensor which is disposed on a discharge path extending from the cooking chamber and measures a content of moisture generated from the food.

4. A microwave oven, comprising:

a heating unit to cook food;

an input unit which receives a cooking condition of the food;

a humidity sensor which measures a content of moisture generated from the food; and a control unit which sets sampling intervals to accumulate humidity values measured by the humidity sensor, and controls a cooking end time of the food according to an accumulated humidity value obtained by accumulating the humidity values measured during learned sampling intervals of the microwave oven in response to the cooking condition set through the input unit corresponding to one of previously learned cooking conditions of the microwave oven.

5. The microwave oven according to claim 4, further comprising a storage medium, wherein:

the previously learned cooking conditions are prior cooking conditions processed by the microwave oven before the setting of the cooking condition, and the control unit performs a learning operation of drawing up a table in which the learned sampling intervals are set to correspond to the respective prior cooking conditions set through the input unit, and stores the table in the storage medium.

6. The microwave oven according to claim 5, wherein each of the learned sampling intervals is set to 2 to 4 seconds.

7. The microwave oven according to claim 4, wherein the learned cooking conditions include a cooking popcorn condition and a warming vegetables condition.

8. A method of controlling a microwave oven having a humidity sensor and a cooking chamber which receives food, the method comprising:

setting a cooking condition of the food;

measuring a condition of air in the cooking chamber using the humidity sensor while a cooking operation of the food is performed according to the set cooking condition;

setting sampling intervals to accumulate humidity values measured by the humidity sensor; and comparing an accumulated humidity value obtained by accumulating the humidity values measured during the set sampling intervals with a preset value and finishing the cooking operation with respect to the set cooking condition according to the compared result.

9. The method of controlling a microwave oven according to claim 8, wherein the finishing of the cooking operation is performed according to an accumulated humidity value obtained by accumulating the humidity values measured during learned sampling intervals of the microwave oven in response to the set cooking condition corresponding to one of previously learned cooking conditions of the microwave oven.

10. The method of controlling a microwave oven according to claim 9, wherein the previously learned cooking conditions are prior cooking conditions processed by the microwave oven before the setting of the cooking condition, and processing of the prior cooking conditions includes:

drawing up a table in which the learned sampling intervals are set to correspond to the respective prior cooking conditions; and storing the table in a storage medium of the microwave oven.

11. The microwave oven according to claim 1, wherein the control unit sets the sampling intervals to adjust a measurement period of the sensor.

12. The microwave oven according to claim 1, wherein each of the sampling intervals corresponds to an interval of a measurement period where the sensor senses the values which vary greatly.

13. The microwave oven according to claim 1, wherein the control unit sets the sampling intervals according to the values scanned by the sensor within a measurement period of the sensor.

14. The microwave oven according to claim 1, further comprising an input unit which receives a cooking condition to cook the food, wherein the control unit controls the cooking end time of the food according to an accumulated value obtained by accumulating the values measured during learned sampling intervals of the microwave oven in response to the cooking condition set through the input unit corresponding to one of previously learned cooking conditions of the microwave oven.

15. The microwave oven according to claim 4, wherein the control unit sets the sampling intervals to adjust a measurement period of the humidity sensor.

16. The microwave oven according to claim 4, further comprising:

a cooling fan which cools the microwave oven;

a cooking tray to receive the food thereon;

a motor which rotates the cooking tray;

a display unit which display operations of the microwave oven;

a display driving unit which drives the display unit;

a motor driving unit which drives the motor;

a fan driving unit which drives the cooling fan; and a magnetron driving unit which drives the heating unit, wherein:

the heating unit includes a magnetron which generates microwaves to cook the food, and the humidity sensor and the input, magnetron driving, fan driving, motor driving, and display driving units are electrically connected to the control unit.

17. The microwave oven according to claim 4, wherein the control unit controls the cooking end time of the food according to the accumulated humidity value obtained by accumulating the humidity values measured during the set sampling intervals in response to the cooking condition set through the input unit not corresponding to one of the previously learned cooking conditions.

18. The microwave oven according to claim 4, wherein each of the sampling intervals corresponds to an interval of a measurement period where the humidity sensor senses the humidity values which vary greatly.

19. The microwave oven according to claim 4, wherein the control unit sets the sampling intervals according to the humidity values scanned by the humidity sensor within a measurement period of the humidity sensor.

20. The microwave oven according to claim 4, wherein the control unit sets the sampling intervals according to the humidity values scanned by the humidity sensor within a plurality of measurement periods of the humidity sensor.

21. The microwave oven according to claim 4, wherein each of the sampling intervals is set to 2 to 4 seconds.

22. The microwave oven according to claim 4, further comprising a rotating tray which receives the food and rotates according to the cooking condition, wherein the control unit determines the cooking end time according to the humidity values measured during one of the set sampling intervals and the learned sampling intervals so as to account for a sampling variation of the humidity values due to a rotation of the rotating tray which varies a distance between the food and the humidity sensor.

23. The method of controlling a microwave oven according to claim 8, wherein the setting of the sampling intervals comprises setting the sampling intervals according to the humidity values scanned by the humidity sensor within a measurement period of the humidity sensor.

24. The method of controlling a microwave oven according to claim 23, wherein the setting of the sampling intervals according to the humidity values scanned includes:

counting a cooking time of the food while scanning the humidity values every set time within the measurement period of the humidity sensor; and setting the sampling intervals according to the humidity values scanned in response to the cooking time being equal to the measurement period.

25. The method of controlling a microwave oven according to claim 8, wherein the setting of the sampling intervals comprises setting the sampling intervals according to the humidity values scanned by the humidity sensor within measurement periods of the humidity sensor.

26. The method of controlling a microwave oven according to claim 10, wherein each of the learned sampling intervals is set according to the humidity values scanned by the humidity sensor within a measurement period of the humidity sensor.

27. A microwave oven, comprising:

a heating unit to cook food;

a cooking chamber which receives the food;

a sensor which measures a condition of air in the cooking chamber; and a control unit which sets sampling intervals, according to the measured condition of the air in the cooking chamber, to accumulate values measured by the sensor, and controls a cooking end time of the food according to an accumulated value obtained by accumulating the values measured during the set sampling intervals.

28. A microwave oven, comprising:

a heating unit to cook food;

an input unit which receives a cooking condition of the food;

a humidity sensor which measures a content of moisture generated from the food; and a control unit which sets sampling intervals to accumulate humidity values measured by the humidity sensor, and controls a cooking end time of the food according to an accumulated humidity value obtained by accumulating the humidity values measured during learned sampling intervals of the microwave oven in response to the cooking condition set through the input unit corresponding to one of previously learned cooking conditions of the microwave oven.

29. A method of controlling a microwave oven having a humidity sensor and a cooking chamber which receives food, the method comprising:

setting a cooking condition of the food;

measuring a condition of air in the cooking chamber using the humidity sensor while a cooking operation of the food is performed according to the set cooking condition;

setting sampling intervals, according to the measured condition of the air in the cooking chamber, to accumulate humidity values measured by the humidity sensor; and comparing an accumulated humidity value obtained by accumulating the humidity values measured during the set sampling intervals with a preset value and finishing the cooking operation with respect to the set cooking condition according to the compared result.

30. A microwave oven, comprising:

a heating unit to cook food;

a cooking chamber which receives the food;

a sensor which measures a condition of air in the cooking chamber; and a control unit which sets sampling intervals, each of which corresponds to an interval in which the measured condition of the air in the cooking chamber varies greatly, to accumulate values measured by the sensor, and controls a cooking end time of the food according to an accumulated value obtained by accumulating the values measured during the set sampling intervals.

31. A microwave oven, comprising:

a heating unit to cook food;

an input unit which receives a cooking condition of the food;

a humidity sensor which measures a content of moisture generated from the food; and a control unit which sets sampling intervals, each of which corresponds to an interval in which the measured condition of the air in the cooking chamber varies greatly, to accumulate humidity values measured by the humidity sensor, and controls a cooking end time of the food according to an accumulated humidity value obtained by accumulating the humidity values measured during learned sampling intervals of the microwave oven in response to the cooking condition set through the input unit corresponding to one of previously learned cooking conditions of the microwave oven.

32. A method of controlling a microwave oven having a humidity sensor and a cooking chamber which receives food, the method comprising:

setting a cooking condition of the food;

measuring a condition of air in the cooking chamber using the humidity sensor while a cooking operation of the food is performed according to the set cooking condition;

setting sampling intervals, each of which corresponds to an interval in which the measured condition of the air in the cooking chamber varies greatly, to accumulate humidity values measured by the humidity sensor; and comparing an accumulated humidity value obtained by accumulating the humidity values measured during the set sampling intervals with a preset value and finishing the cooking operation with respect to the set cooking condition according to the compared result.

* * * * *